United States Patent [19]

Romanauskas

[11] 4,375,871

[45] Mar. 8, 1983

[54] ROTATING SEAL FOR CENTRIFUGES

[75] Inventor: William A. Romanauskas, Southbury, Conn.

[73] Assignee: E. I. Du Pont de Nemours and Company, Wilmington, Del.

[21] Appl. No.: 249,961

[22] Filed: Apr. 1, 1981

[51] Int. Cl.[3] ..... B04B 11/00

[52] U.S. Cl. ..... 494/41; 277/74; 494/14; 494/15; 494/60

[58] Field of Search ..... 233/21, 22, 16, 19 R, 233/19 A, 12, 14 R, 1 A, 1 R, 27, 28; 277/18, 25, 27, 74

[56] References Cited

U.S. PATENT DOCUMENTS 3,292,937 12/1966 Nunley ..... 233/21
3,443,747 5/1969 Jacobson ..... 233/22
4,011,972 3/1977 Pederson et al. .

FOREIGN PATENT DOCUMENTS 1910576 9/1970 Fed. Rep. of Germany .
925677 5/1963 United Kingdom .

*Primary Examiner*—Robert W. Jenkins

[57] ABSTRACT

A rotating seal for a continuous flow centrifuge is disclosed. The rotating seal is mounted at the center of mass of the rotor to reduce vibration of the seal. The nonrotating portion of the rotating seal is maintained in contact with the rotating portion of the seal by a three point spring secured to a housing which is resiliently mounted to the chamber which encloses the rotor. In this manner, the nonrotating disk is able to follow the reduced amplitude vibrations of the rotating disk with reduced leakage.

8 Claims, 4 Drawing Figures

ROTATING SEAL FOR CENTRIFUGES

CROSS REFERENCE TO RELATED APPLICATIONS

This application is related to inventions described in copending applications Ser. No. 125,854, filed Feb. 29, 1980, entitled "Drive for Rotating Seal" by Charles Heritage Dilks, Jr.; and Ser. No. 249,965, filed Apr. 1, 1981, entitled "Centrifugal Oil Pump" by William Andrew Romanauskas (IP-0261).

BACKGROUND OF THE INVENTION

This invention relates to rotating seals for continuous flow centrifuges.

Continuous flow centrifuges provide a continuous flow of fluid into and out of a spinning rotor. This is accomplished by the use of rotating seals having a rotating disk and a stationary disk in face-to-face contact. Typical of rotating seals used in centrifuges of this type are those described in U.S. Pat. No. 4,011,972 issued to Pederson, British Pat. No. 925,677 and German Offenlegungsschrift No. P 19 10 576.1 filed by Heraeus Christ of Germany.

In the rotating seals described in these prior art patents, the rotating disk is coupled by a flexible shaft to the rotor while the stationary or nonrotary disk is spring mounted to the rotor housing. While the rotating seals used in these prior continuous flow centrifuges have certain advantages, they also have many drawbacks. Among these drawbacks are that the rotating seal causes the nonrotating disk to "toss" because of misalignment induced vibrations between the contacting disk faces. Also, vibrations of the rotor are amplified by the shaft coupling the rotor and seal.

To alleviate some of these problems, the prior art sought to isolate the seal from the system vibration by the use of spring pressure to maintain good contact between the disk faces. Unfortunately, too strong a spring pressure causes undue wear of the seal faces. Vibrations in the system tend to cause leakage between the seal faces, particularly in situations where the rotor is not perfectly balanced.

This vibration induced leakage becomes a particular problem in sedimentation field flow fractionation (SFFF), a technique described in U.S. Pat. No. 3,449,938 issued June 17, 1969 to John C. Giddings and U.S. Pat. No. 3,523,610 issued Aug. 11, 1970 to Edward M. Purcell and Howard C. Berg. Sedimentation field flow fractionation uses a long, thin annular belt-like channel which is rotated about the axis of the channel annulus. Because the belt-like channel has a significant mass located at extreme radial distances from the axis of rotation, vibrations induced in this system can be severe. Under these conditions, existing seals have been found to be not entirely satisfactory. As noted, even small vibrations of the rotating system are amplified by the rotating shaft which connects the rotating seal and rotor. This serves only to increase the leakage.

BRIEF DESCRIPTION OF THE INVENTION

A continuous flow centrifuge apparatus is constructed to provide an improved rotating seal that is less subject to vibrational problems and is able to maintain a better surface-to-surface contact of the seal disks and thus reduce seal leakage. The centrifuge has a rotor housed in a chamber. The rotor is mounted on a drive shaft for rotation within the chamber about the axis of the drive shaft. A rotating seal having engaged rotary and nonrotary members is used for conveying fluids to and from the rotor while spinning.

According to this invention, the rotating seal is located at the center of mass of the rotor and on the drive shaft axis. This reduces vibrations to which the seal is subjected since rotor vibrations are not amplified by the seal drive shaft. Seal mounting is greatly facilitated and the rotary member of the seal is fixedly mounted to the rotor itself. The nonrotary member of the seal is resiliently mounted on the chamber to maintain rotary contact between the rotary and nonrotary members. The resilient mounting includes a sleeve-like bearing housing secured to the rotor chamber by a flexible coupling means. The nonrotary member includes a flat spring, fixedly mounted at three spaced points within the sleeve-like bearing, with the nonrotary member supported centrally and resiliently by the spring mounting, i.e., the nonrotary member floats.

With this construction, the rotating seal is subjected to reduced vibration and the floating spring mounted nonrotary member is better able to follow the relatively reduced amplitude vibrations of the rotary member. Preferably, the nonrotary member is constructed of a low mass. The three point spring permits the low mass, nonrotary member to more easily follow the misalignments of the rotary member, thus producing an enhanced seal life and reduced leakage.

BRIEF DESCRIPTION OF THE DRAWINGS

Further advantages and features of this invention will become apparent from the following description wherein.

DETAILED DESCRIPTION OF THE PREFERRED EMBODIMENT

Figure 1:
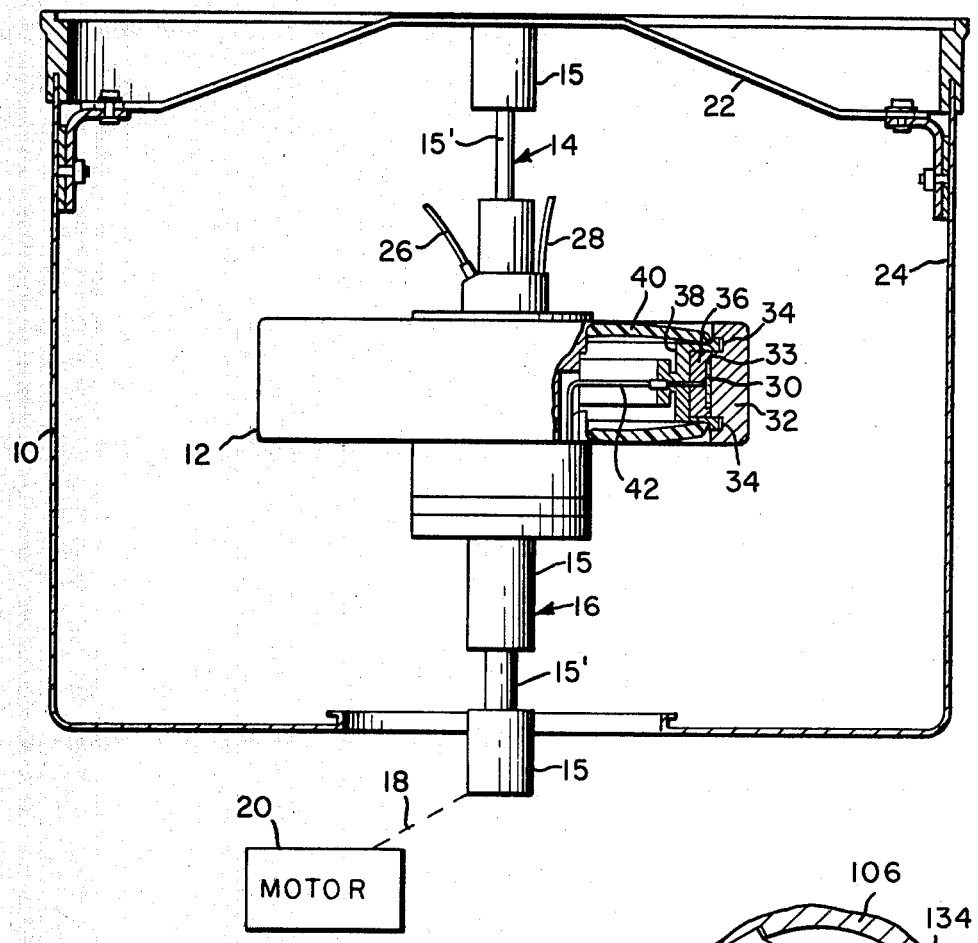
FIG. 1 is a cross-sectional, elevation view of a continuous flow centrifuge in which the rotating seal of this invention finds use.

The rotating seal of this invention will be described in the context of an SFFF type of continuous flow centrifuge. It is to be understood, however, that it may be used with any type of continuous flow centrifuge. With reference to FIG. 1, there is seen a centrifuge which includes a housing or chamber 10 for housing an SFFF type rotor 12 supported by upper and lower flexible couplings 14 and 16, respectively. The preferred flexible shaft couplings may be Heli-cal TM rotating shaft flexible couplings sold by Helical Products Company, Inc. Each coupling consists of a pair of flexible helical elements 15 connected by a rigid shaft 15'. Each element 15 is one in which the helical flexible configuration is a curved beam. The curved beam is made by developing a helical groove around the outside diameter of a cylinder leaving a web which resembles a knife blade wrapped edgewise around an axial wire. This form of coupling permits maximum torsional rigidity and torque capacity. Although the Heli-cal TM flexible coupling is preferred, other known flexible shaft couplings may be used as desired.

The lower flexible coupling 16 is rotating and is coupled through a suitable linkage, which may be gears or a belt drive, depicted by the dashed line 18, coupled to a suitable prime mover such as a motor 20. The upper flexible coupling 14 is nonrotating and is secured by a mechanical support 22 to the sides 24 of the chamber 10 by any suitable means. Conduits 26 (only one is shown for clarity) for transmitting fluids to the rotor are coupled through the upper flexible coupling 14. A separate conduit 28 is connected to a source of cooling water for cooling the bearing and hence reducing heating of the rotating seal. Such heating is undesirable particularly when using biological materials. In each instance the conduits 26 and 28 are shown singularly for clarity of illustration. In actual practice two conduits 28 are required to provide water to and from the system and two or three conduits 26 are used for the rotor, depending upon the particular system used. In SFFF, typically three conduits typically are used.

Although a bowl type continuous flow rotor may be used, the seal of this invention is particularly useful in conjunction with SFFF. Rotors for SFFF have an annular ring-like (alternatively, belt-like or ribbon-like) flow channel 30 having a relatively small thickness (the radial dimension). The channel 30 is defined by a groove formed in the outer peripheral surface of a resilient inner ring 36 formed out of a suitable chemically inert, strong, yet resilient material such as polytetrafluoroethylene. Other known materials of this type such as polyethylene or polyurethane may also be used. The lands 33 remaining on either side of the groove are maintained in contact with the inner surface of an outer support ring 32, to maintain a leak-free channel 30, by loaded ring segments 38. These segments 38 are U-shaped in cross section with the ends of the U engaging grooves 34 formed in the radially inner surface of the support ring 32, thus forming a load ring. The support ring may be formed of a suitable material having a high tensile strength as is typically used in centrifuges such as titanium, stainless steel or aluminum. In this manner, as the outer ring 32 expands under the influence of centrifuge force, the inner ring 36 is forced by the segments 38 to expand a like amount to maintain contact between the rings.

The flow channel 30 is maintained intact when the rotor is at rest, and is mounted for rotation about the axis of the drive system, by a pair of compression washers 40 which are annular in configuration. Each washer is generally convex in cross section and springy so as to force the segment 38 of the load ring radially outward toward the support ring 32, thus maintaining the inner ring 36, which defines the channel 30, in constant compression against the support ring 32. Fluids are conducted to and from the channel 30 as by the conduits (only a single conduit being shown) within the confines of the rotor 12 through the rotating seal. The flow channel is described and claimed in the copending Romanauskas application Ser. No. 249,963, filed Apr. 1, 1981, now U.S. Pat. No. 4,353,795, and entitled "Field Flow Fractionation Channel".

Figure 4:
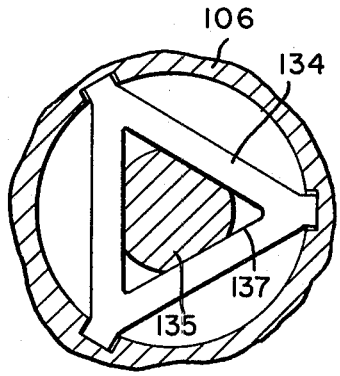
FIG. 4 is a partial plan view of the spring mounting for the nonrotary disk of the rotating seal of FIG. 2.
Figure 2:
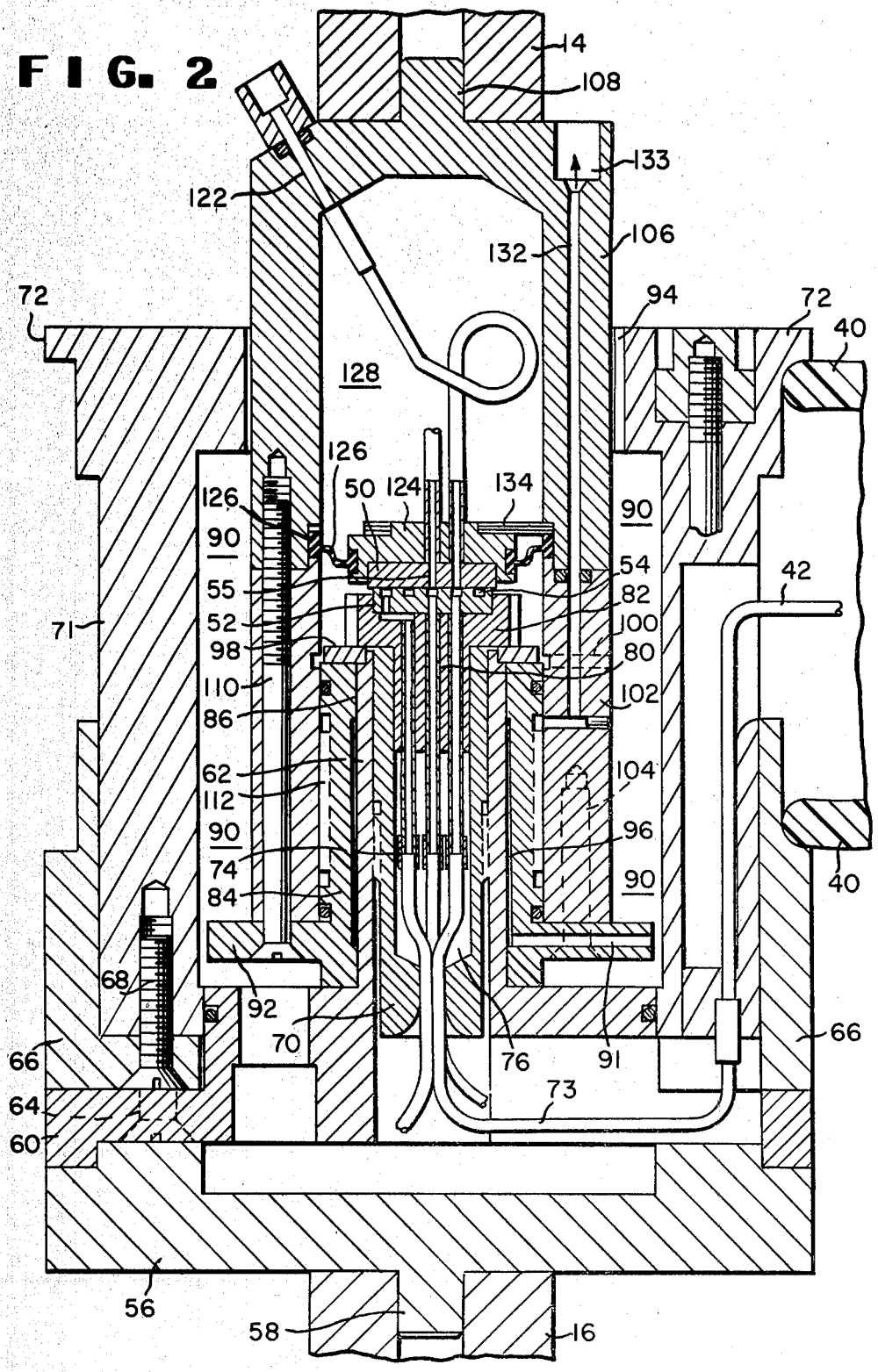
FIG. 2 is a cross-sectional elevation view of the rotating seal assembly used in the centrifuge of FIG. 1.
Figure 3:
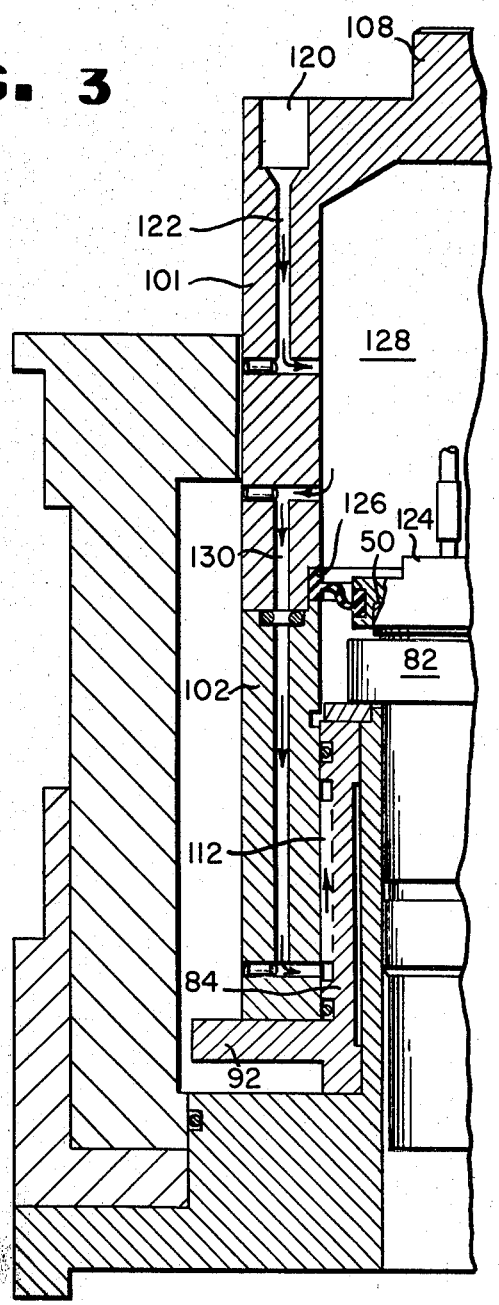
FIG. 3 is a partial, cross-sectional elevation view of a portion of the seal assembly of FIG. 2 particularly depicting the manner in which cooling water is directed to the bearing which supports the rotating seal.

The details of the rotating seal of this invention are most clearly seen in FIGS. 2, 3, and 4. The rotating seal assembly is secured between the fixed or nonrotating flexible coupling 14 and the lower rotating flexible coupling 16 (FIG. 1). The seal assembly itself includes an upper face seal or nonrotating disk 50 in compression against a lower face seal or rotating disk 52, the rotating disk 52 having annular grooves 54 therein to provide flow channels radially aligned with bores 55 formed in the upper face seal 50. The disks 50–52, which comprise the rotating seal, are supported within the rotating seal assembly by a rotating portion and nonrotating portion.

The rotating portion includes a base 56 secured as by a nipple 58 to the lower rotating flexible coupling 16. The base 56 is secured as by suitable screws (not shown) to the disk portion 60 of a journal post 62. The disk portion 60 is secured and turned, as by suitable screws 64, to a sleeve-like, spring loading ring 66 which supports the lower compression washer 40. In turn, the loading ring 66 is secured, as by a screw 68, to an annular rotor hub 71, the top portion of which is flanged as at 72 to provide a mounting for the upper compression washer 40. The journal post 62 is sleeve-like to accommodate a seal housing 70 which is threaded within the journal post 62. The seal housing 70 is hollow and accommodates stainless steel or other suitable conduits 80 which are potted in place by a suitable potting compound 76. The stainles steel tubes or conduits 80 pass through a lower face seal housing 82, seated in the seal housing 70. The lower face seal 52 is seated in the housing 82 so that the conduits 80 communicate with the several annular grooves 54 in the face seal 52. The conduits 80 are coupled by the ferrules 74 to suitable plastic tubes 73 (polytetrafluoroethylene), thence through conventional coupling screws in the rotor hub 70 to stainless steel manifold tubing 42 (FIG. 1), thence through coupling screws in the inner ring 36 to the flow channel 30 (FIG. 1).

The outer periphery of the journal post 62 forms the rotating portion of a journal bearing 84. The journal bearing 84, which may be a sleeve bearing, has upper and lower stationary contact surfaces 86 which engage the periphery of the journal post 62. The contacting surfaces 86 of the journal bearing 84 are lubricated with a lubricant in a conventional manner but preferably they are lubricated in accordance with the invention described in the copending Romanauskas application entitled "Centrifugal Oil Pump", filed Apr. 1, 1981, Ser. No. 249,965. Lubrication is accomplished by forming the journal bearing 84 with a flange 92 at the lower region of the bearing which flange 92 extends into an annular cavity 90 formed by the rotor hub 71. A radial bore 91 is formed in the flange 92 and may be slightly angled against the direction of rotation of the rotor. If now oil is introduced through a passage 94 in the hub 71 into the cavity 90, when the rotor spins, the oil under centrifugal force will fill the outer wall of the cavity 90 and rotate with the rotor. The rotating oil is thus formed through the bore 91 into the annular region 96 between the journal bearing and post 84, 62, thus lubricating the contacting bearing surfaces 86. The oil flow returns between a flange bearing loading washer 98 and the top of the journal bearing 84 and through a bore 100 in the lower housing 102 for the bearing assembly. The lower housing 102 is sleeve-like and secured as by screws 104 to the pump flange 92. In turn, the lower housing 102 is secured to an upper bearing housing 106, which is generally cylindrical, enclosed at the upper end, and mounted as by nipple 108 to the upper flexible coupling 14. Screws 110 secure the upper bearing housing 106 to the lower bearing housing 102 and the pump flange 92.

Cooling water is supplied to the annular cavity 112 formed by the exterior of the journal bearing 84 and the inner surface of the lower housing 102. The water flow path is from a suitable exterior connector 120 (FIG. 3) and bores 122 to the hollow region above the floating seal 50 within the upper bearing housing 106. The floating seal 50 itself is housed by an upper face seal housing 124. A flexible coolant seal 126, secured between the upper seal housing 106 and the upper face seal housing 124, completes the chamber 128 for the water. Water leaves the chamber 128 through a second series of bores 130 (FIG. 3) in the upper seal housing 106 and the lower housing 102 to the annular region 112 around the bearing 84. This annular region may be formed with a spiral to control the water flow about the bearing. The return path from region 112 is through a similar series of bores 132 in the lower housing 102 and upper housing 106 to a connector 133.

In accordance with this invention, the upper face seal housing 124 is spring mounted by a flat seal spring 134 which is triangular in configuration, as best seen in FIG. 4. The tips of the triangular apices of the spring engage slots in the interior wall of the upper seal housing 106. In this manner, the floating disk 50 is allowed, because of the triangular support, to follow vibrational movements of the lower face seal 52 and maintain good contact therebetween. The upper face seal housing 124 has a stud 135 which is keyed into a slot 137 formed in the spring 134 to prevent seal rotation.

The rotating seal 50, 52 is located essentially at the center of mass of the rotor. Accordingly, vibrations of the rotor are not amplified by the mechanical configuration as tends to occur in many of the rotating seals of the prior art.

In a preferred embodiment of the invention, the floating or nonrotating seal 50 is formed of a lightweight material such as a carbon graphite composite material, whereas the rotating disk 52 is formed of a hard material such as silicon carbide. Being lightweight, the floating seal 50 is more easily able to follow and maintain contact with the rotating seal.

With the configuration shown, an improved rotating seal is provided which maintains good contact during operation even in the presence of vibrations. Of course, with the construction of this invention the vibrations are of reduced amplitude.

I claim:

1. In a continuous flow centrifugal apparatus having a housing and a rotor mounted on a drive shaft for rotation within said housing about the axis of said drive shaft, and a rotating seal having interengaged rotating and nonrotating members for conveying fluids to and from said rotor, the improvement wherein:

the rotating seal is located about at the center of mass of said rotor and on said drive shaft axis.

2. The apparatus of claim 1 wherein said rotating member is fixedly mounted to said rotor.

3. The apparatus of claim 1 or 2 which includes mounting means to resiliently mount said nonrotating member on said housing, thereby to maintain good rotating contact with said rotating member.

4. The apparatus of claim 3 wherein said nonrotating member has a low mass to maintain continuous contact with said rotating member.

5. The apparatus of claim 1 or 2 which includes a flat, triangular spring fixedly mounted at the apices of the triangle, said nonrotating member being supported by said spring centrally of said apices.

6. The apparatus of claim 1 or 2 wherein said nonrotating member is resiliently mounted on said housing and has a low mass to maintain continuous contact with said rotating member.

7. The apparatus of claim 6 wherein said nonrotating member is constructed of a composite material.

8. The apparatus of claim 6 which includes mounting means to resiliently mount said nonrotating member to said housing, said mounting means including a sleeve-like bearing secured to said rotor housing by a flexible coupling means and engaging a portion of said rotor.

* * * * *